United States Patent [19]

Deakin et al.

[11] Patent Number: 4,911,419

[45] Date of Patent: Mar. 27, 1990

[54] CLAMPING DEVICE

[76] Inventors: Keith N. Deakin, 80 Mill Lane, Kirkella, North Humberside; Ronald Mann, 16 Humber View, Tranby Avenue, Hessle, both of England

[21] Appl. No.: 173,818

[22] Filed: Mar. 28, 1988

[30] Foreign Application Priority Data

Mar. 28, 1987 [GB] United Kingdom ..... 8707476

[51] Int. Cl.[4] ..... B25B 1/02

[52] U.S. Cl. ..... 269/208; 269/244; 269/277

[58] Field of Search ..... 269/277, 901, 900, 140, 269/244, 208, 283, 141, 142, 146, 95; 144/280 R, 287; 248/316, 4

[56] References Cited

U.S. PATENT DOCUMENTS

| | | | |
|---|---|---|---|
| 1,059,830 | 6/1912 | Carter | 269/208 |
| 3,220,691 | 11/1965 | Dudley | 269/208 |
| 4,328,846 | 5/1982 | Hanson | 269/901 |

*Primary Examiner*—Judy Hartman

*Attorney, Agent, or Firm*—Burns, Doane, Swecker & Mathis

[57] ABSTRACT

A clamping device comprising an elongate bar (1) a first abutment member (2) fixed in position on the elongate bar (1) and a second abutment member (3) slidably mounted on the elongate bar (1). A peg (12,17) carried by both the elongate bar (1) and the second abutment member (3) enables each to be secured to a respective jaw of a vice such that in use movement of the jaws of the vice relative to one another results in a corresponding movement of the two abutment members (2,3) relative to each other.

7 Claims, 2 Drawing Sheets

CLAMPING DEVICE

BACKGROUND AND SUMMARY OF PRESENT INVENTION

The present invention relates to a clamping device and more particularly to a clamping device for attachment to the jaws of a vice which increases the maximum effective distance to which the jaws of the vice can be opened. The present invention is especially, although not exclusively, intended for use with a Black & Decker "Workmate" ("Workmate" is a registered trade mark).

The Black & Decker "Workmate" is a popular form of portable work bench which comprises a collapsable support stand upon which is mounted a work surface. The work surface itself is comprised of two sections, one of which is fixed in position on the work stand and the other one of which is mounted on screw threaded runners carried by screw threaded rods. A handle is attached to the end of each screw threaded rod so that it can be rotated and this causes the screw threaded runner carried by it to travel along the rod, thus moving the section relative to the fixed section. In this way the two sections of the work surface define the jaws of a vice.

The length of the screw threaded rods determines the maximum distance of travel of the runners and hence the maximum effective distance to which the jaws of the vice can be opened. In the case of the Black & Decker "Workmate" this is limited to a few inches which severely curtails the applications to which the Black & Decker "Workmate" can be put. For example, should the user wish to work on the surface of a door or a large panel it cannot be accommodated between the jaws of the vice and must be rested loose on the work surface instead, which for obvious reasons is most unsatisfactory.

In order to increase the maximum effective distance to which the jaws of the vice can be opened Black & Decker have provided clamping attachments for the Black & Decker "Workmate". Essentially, each clamping attachment comprises a plastic peg having an abutment surface. Each peg is located in a hole in the work surface, specifically provided for the purpose, so that the abutment surface lies substantially normal to the work surface, and at least one peg is provided for each jaw of the vice so that the pegs carried by each jaw can be moved relative to each other to clamp a workpice laid on the work surface between the abutment surfaces of the pegs. Thus the maximum effective distance to which the jaws of the vice can be opened is increased by the distance between the pegs carried by each jaw of the vice.

However, whilst these pegs provide an improvement on the basic vice, they are still not completely satisfactory. Being made of plastic they frequently shear or snap in two when in use. But more importantly, the distance between the pegs carried by each jaw of the vice is limited to the width of the work surface in which the locating holes are provided. As the Black & Decker "Workmate" is intended to be portable the size of the work surface is limited and thus, even when these pegs are used, the maximum effective distance to which the jaws of the vice can be opened is only increased by perhaps ten or twenty inches. Certainly, the Black & Decker "Workmate" is still not capable of clamping workpieces measuring feet rather than inches to it.

It is an object of the present invention to provide a clamping device for attachment to the jaws of a vice, and more particularly to the jaws of a Black & Decker "Workmate", in which the maximum effective distance the jaws of the vice can be opened is substantially increased.

According to the present invention there is provided a clamping device comprising an elongate bar, a first abutment member fixed in position on the elongate bar, a second abutment member slidably mounted on the elongate bar and means for securing the elongate bar and the second abutment member each to a respective jaw of the vice such that in use movement of the jaws of the vice relative to one another results in a corresponding movement of the two abutment members relative to each other.

Preferably, the first abutment member is also slidably mounted on the elongate bar, but can be fixed in position at predetermined points along the elongate bar by means of a locking pin or peg which is inserted into any one of a plurality of holes in the elongate bar so as to prevent movement of the first abutment member beyond the hole.

The locking pin or peg may comprise a split pin and to prevent loss thereof it is conveniently attached to the first abutment member by means of a short length of chain. However, in a preferred embodiment of the present invention the locking pin or peg is supported between opposite sides of the first abutment member and extends in a generally vertical direction to engage in any one of a plurality of holes in the upper and/or lower surface of the elongate bar. In this respect, it will be appreciated that the locking pin is generally T-shaped with the horizontal bar thereof supported by the side walls of the first abutment member. The horizontal bar of the T-shaped locking pin or peg may be pivotable relative to the sides of the first abutment member to facilitate engagement and disengagement of the vertical leg from the said holes in the elongate bar.

Alternatively, the T-shaped locking pin or peg may be rigidly secured to, or is integrally formed with first abutment member and the first abutment member can be raised and lowered relative to the elongate bar to engage and disengage the vertical leg in the holes in the elongate bar.

Preferably, the said securing means each comprise a peg which is adapted in use to be located in a hole in the upper surface of a vice jaw. Such holes are already provided in the Black & Decker "Workmate", but with other types of vice they may need to be drilled in before the clampng device can be used.

Conveniently, each peg is of sufficient length to extend through and beyond the bottom of the hole in the vice jaw and is secured in place either by means of a split pin which is passed through a hole in the end of the peg or by means of a circlip which is engaged in a circumferential groove formed around the end of the peg.

Preferably, the said second abutment extends longitudinally along the elongate bar and defines an abutment surface towards one end thereof and said securing means towards the other. It will be realised that this configuration increases the distance between the abutment surface and the securing means and allows the abutment surface to lie beyond the outer edge of the vice jaw. This is important with large workpieces as it allows the clamping device to be centred on the vice jaws and ensures that the workbench carrying the vice jaws is not unbalanced when the work piece is clamped in position.

Preferably, the position of the securing means carried by the elongate bar is adjustable between a first position in which it lies at one end of the elongate bar and a second position in which it lies approximately midway between the ends of the elongate bar. This allows the positions of the first and second abutment members relative to the outer edges of the vice jaws to be varied and allows the user to position the clamping device on the vice jaws so that the workbench carrying the vice jaws is not unbalanced when a workpiece is clamped in position.

Preferably, the elongate bar, the first and the second abutment members are all formed from pressed and shaped sheet steel. This method of fabrication is very much simpler and less expensive than forming the parts by casting.

In use, the clamping device is secured to the jaws of a vice with the elongate bar secured to one jaw and the second abutment means secured to the other jaw. The first abutment member is moved along the elongate bar so that the distance between it and the abutment surface of the second abutment member will approximately accommodate the workpiece to be held and is then fixed in position by engaging the locking pin or peg in the hole in the elongate bar nearest to this position. Now by moving the vice jaws relative to each other the first and second abutment means can be moved relative to each other to take up the slack and clamp a workpiece. In other words coarse adjustment of the distance between the first and second abutment members is achieved by moving the first abutment member along the elongate bar and fine adjustment is achieved by opening or closing the vice jaws to move the first and second abutment members. Depending upon the length of the elongate bar the distance between the first and second abutment members can be varied from a couple of feet to several feet.

BRIEF DESCRIPTION OF THE DRAWINGS

An embodiment of the present invention will now be described, by way of example, with reference to the accompanying drawings, in which.

DETAILED DESCRIPTION OF A PREFERRED EMBODIMENT

Figure 1:
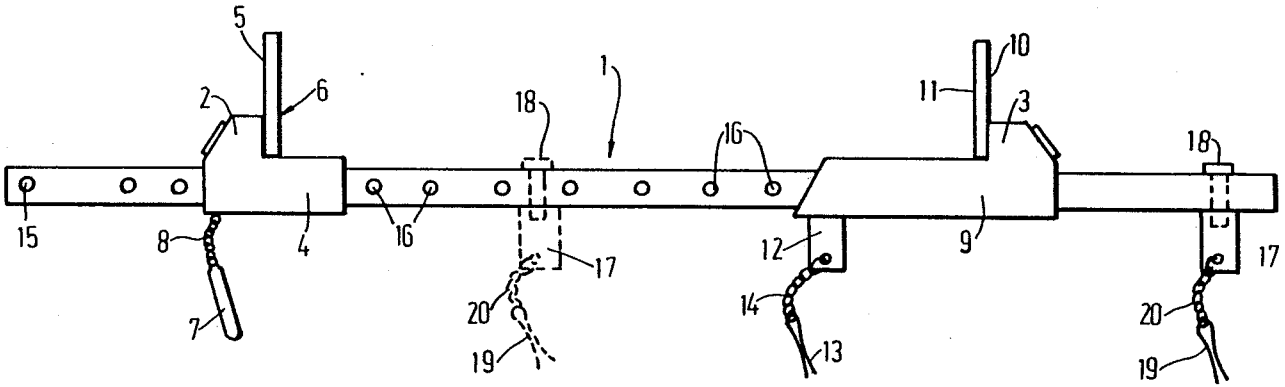
FIG. 1 shows a side view of a clamping device according to the present invention.

Referring to FIG. 1 of the accompanying drawings there is shown a clamping device comprising an elongate bar 1 of square cross-section, a first abutment member 2 and a second abutment member 3. The first abutment member 2 comprises a tubular support 4 which is slidable along the length of the elongate bar 1 and a vertical stop 5 defining an abutment surface 6. A locking pin 7 is attached to the abutment member 2 by means of a short length of chain 8. The second abutment member 3 also comprises a tubular support 9 which is slidable along the length of the elongate bar 1 and a vertical stop 10 defining an abutment surface 11, but the tubular support 9 is much longer than the tubular support 4 and comprises a downwardly extending securing peg 12 at the opposite end thereof from the vertical stop 10. A locking pin 13 is attached to securing peg 12 by means of a short length of chain 14.

The elongate bar 1 has a stop 15 at one end to prevent the abutment means 2 and 3 from sliding off, and along its length a plurality of through holes 16 are provided in its sides. In addition, a downwardly extending securing peg 17 is attached to the elongate bar 1. The securing peg 17 is secured to the elongate bar 1 by means of a screw 18 which passes through the elongate bar to engage in a screw threaded portion in the top of the securing peg 17 and the securing peg 17 can be secured to the elongate bar 1 either at the opposite end thereof from the stop 15 or midway between the two ends of the elongate bar 1. A locking pin 19 is attached to securing peg 17 by means of a short length of chain 20.

Figure 2:
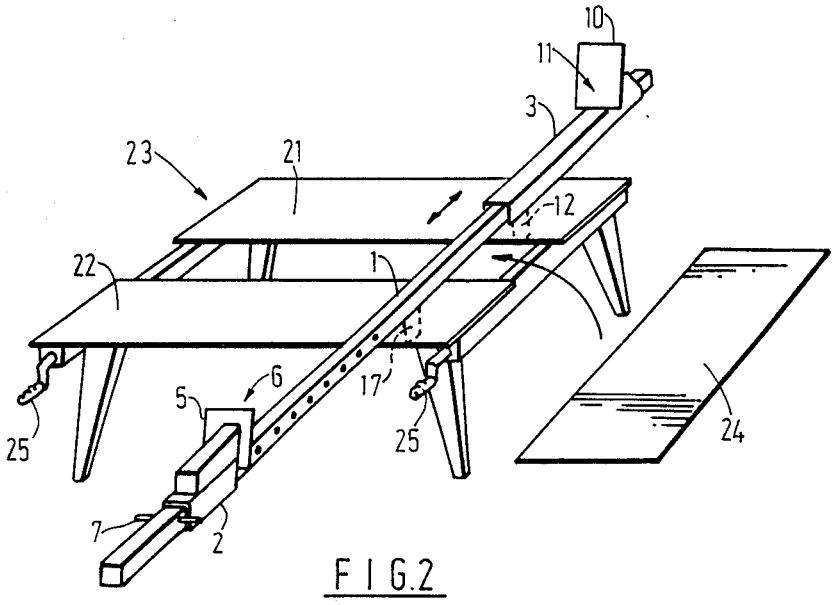
FIG. 2 shows a schematic perspective view of the clamping device of FIG. 1 mounted on the jaws of a Black & Decker "Workmate" work bench according to a first mode of use.

Referring now to FIG. 2 of the accompanying drawings use of the clamping device with a Black & Decker "Workmate" in a first mode will be described.

In this first mode the securing peg 17 is secured approximately midway between the ends of the elongate bar 1 with the first abutment member 2 trapped on the elongate bar 1 between the securing peg and the stop 15. The second abutment member 3 is free to slide along the remaining length of the elongate bar 1 up to and beyond the end thereof as no stop is provided. The securing pegs 12 and 17 carried by the second abutment member 3 and the elongate bar 1, respectively, are each located in a respective hole in a respective one of the two sections 21 and 22 defining the vice jaws of the Black & Decker "Workmate" 23. From an operational point of view it does not matter which of the securing pegs 12 and 17 is located in the fixed section and which in the movable section, but to facilitate an understanding of the clamping device section 21 is movable and section 22 is fixed.

Once the securing pegs 12 and 17 have been located in the holes in the sections 21 and 22 they are locked in place with the locking pins 13 and 19 which pass through holes in the securing pegs 12 and 17 beneath sections 21 and 22. Now the distance between the abutment surfaces 6 and 11 of the first and second abutment members 2 and 3 is adjusted to accommodate a workpiece 24. This is done by sliding the first abutment member 2 along the elongate member 1 until the workpiece 24 can drop in between the abutment surfaces 6 and 11. The position of the first abutment member 2 is then fixed by slipping the locking pin 7 into the hole in the elongate member 1 immediately behind the first abutment member 2. Now section 21 can be moved towards section 22 by turning handles 25 in conventional manner which in turn causes the second abutment member 3 to slide along the elongate member 1 towards the first abutment member 2 clamping the workpiece in place.

In this mode the ends of the elongate bar 1 overhang the sides of the sections 21 and 22 almost equally and so very large workpieces can be accommodated on the Black & Decker "Workmate" without unbalancing it. Moreover, the maximum distance between the abutment surfaces 6 and 11 is possible.

Figure 3:
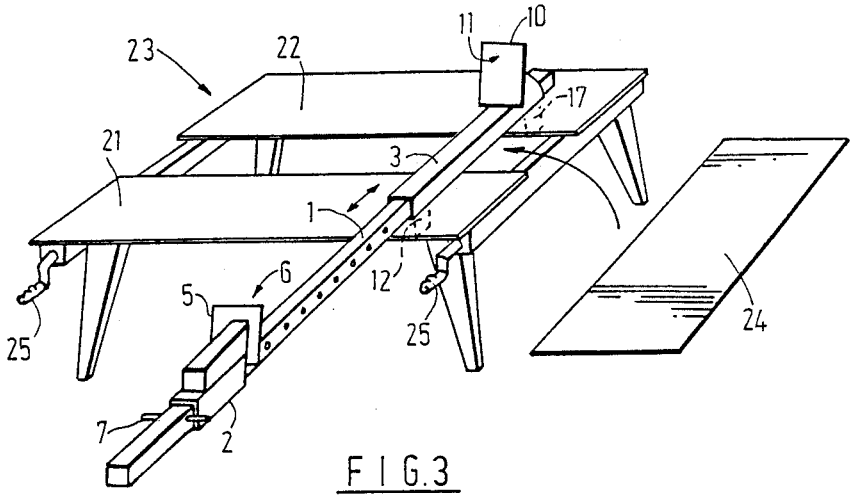
FIG. 3 shows a schematic perspective view of the clamp attachment of FIG. 1 mounted on the jaws of a Black & Decker "Workmate" workbench according to a second mode of use.

Referring now to FIG. 3 of the accompanying drawings use of the clamping device with a Black & Decker "Workmate" in a second mode will be described.

In this second mode the securing peg 17 is secured towards the end of the elongate bar 1 so that both the first and second abutment members 2 and 3 are trapped between it and the stop 15. Again, the securing pegs 12 and 17 carried by the second abutment member 3 and the elongate bar 1, respectively, are each located in a respective hole in a respective one of the two sections 21 and 22 defining the vice jaws of the Black & Decker "Workmate" 23 and are locked in place with the locking pins 13 and 19. As previously described the distance between the abutment surfaces 6 and 11 of the first and second abutment members 2 and 3 is adjusted to accommodate a workpiece 24 by sliding the first abutment member 2 along the elongate member 1 until the workpiece 24 can drop in between the abutment surfaces 6 and 11. The position of the first abutment member 2 is then fixed by slipping the locking pin 7 into the hole in the elongate member 1 immediately behind the first abutment member 2 and now section 21 can be moved towards section 22 by turning handles 25 in conventional manner which in turn causes the second abutment member 3 to slide along the elongate member 1 towards the first abutment member 2 clamping the workpiece in place.

It will be appreciated that this second mode of operation is essentially identical to that of the first mode described with reference to FIG. 2. However, with this second mode the two abutment surfaces 6 and 11 can be brought a little closer together and the position of the workpiece 24 over the two sections 21 and 22 is altered which may make working on it easier than in the other mode of operation.

Although not shown in the accompanying drawings the pegs 12 and 17 may be provided with a number of holes through them, one above the other, to accomodate the locking pins 13 and 19 as close to the bottom of the two sections 21 and 22 as possible. This ensures that whatever the thickness of the sections 21 and 22 the clamping device is always held down tightly against the upper surface of the two sections 21 and 22 and will not jump about when a workpiece is secured in position.

Figure 4:
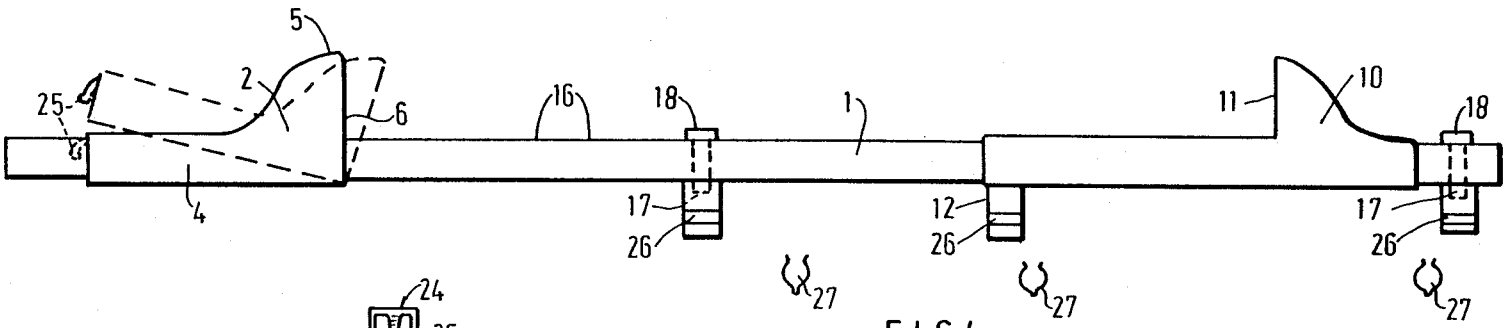
FIG. 4 shows a side view of a second embodiment of a clamping device according to the present invention.
Figure 4A:
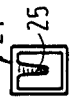

Referring now to FIG. 4 of the accompanying drawings there is shown a clamping device according to a second embodiment of the present invention, in which those parts which are also to be found in the embodiment of FIG. 1 have been identified with the same reference numerals.

In the embodiment of FIG. 4 the elongate bar 1, the first abutment member 2 and the second abutment member 3 are all formed from pressed and folded sheet steel blanks. This very much simplifies manufacture and results in a considerable saving in production costs. In all essential respects the clamping device is identical to that shown in FIG. 1 except that the first abutment member 2 and the securing means 12 and 17 are not secured in position by means of locking pins.

In the case of the first abutment member 2 a T-shaped portion 24 is formed at the far end thereof from the abutment surface 5. The horizontal bar (not visible) of the T-shaped portion 24 is supported between the sides of the first abutment member 2 such that the vertical leg 25 thereof extends downwardly therebetween. This vertical leg 25 is adapted to engage in any one of a plurality of holes (not visible) in the upper surface of the elongate bar 1, thereby locating and securing the first abutment member 2 in position along the elongate bar. To facilitate engagement of the vertical leg 25 in each of the holes the bottom surface of the first abutment member 2 is cut away behind the abutment surface 5 so that the end of the first abutment member 1 carrying the T-shaped portion 24 can be raised (as shown in dotted line) to disengage the vertical leg 25 from the holes, or lowered (as shown in solid line) to engage the vertical leg 25 in one of the holes.

The securing means 12 and 17 each comrpise a circumferential groove 26 towards the end removed from the elongate bar and a circlip 27 engages in this groove when the securing means has been positioned in a hole in a vice jaw to secure the clamping device to the vice jaw.

We claim:

1. A jaw extending clamping device comprising:

an elongate bar, a first abutment means selectively fixable in a plurality of locations along said elongate bar, a second abutment means slidably mounted on said elongate bar, a first securing means for securing said elongate bar to a first jaw of a vice, a second securing means for securing said second abutment means to a second jaw of a vice, whereby relative movement of said first and second jaws results in corresponding relative movement of at least one of the elongate bar and the second abutment means, resulting in corresponding movement of said first and second abutment means such that a workpiece may be clamped between said first and second abutment means.

2. A clamping device according to claim 1, wherein said first abutment means is selectively fixed at a predetermined location along the length of said elongate bar by a locking pin, said locking pin being insertable through said first abutment means into one of a plurality of holes disposed in said elongate bar.

3. A clamping device according to claim 1, wherein each of said first and second securing means comprise a peg insertable into a peg-hole in an upper surface of each of said first and second jaws.

4. A clamping device according to claim 3, wherein each peg is securable within said peg-hole by a locking pin, said locking pin insertable through a locking-pin-hole located at an end of each peg.

5. A clamping device according to claim 3, wherein each peg is securable within said peg-hole in said upper surface of each of said first and second jaws by a circlip engaging a circumferential groove at an end of each peg.

6. A clamping device according to claim 1, wherein said second abutment means includes a longitudinal sleeve adapted for use as a passageway for said elongate bar, said sleeve comprising an abutment surface disposed substantially at a first end of said sleeve and said first securing means disposed substantially at a second end of said sleeve.

7. A clamping device according to claim 1, wherein said first securing means for said elongate bar is adjustable between a first position located at a first end of said elongate bar and a second position located substantially midway between said first end of said elongate bar and a second end of said elongate bar.

* * * * *